US007638093B2

(12) United States Patent
Wang et al.

(10) Patent No.: US 7,638,093 B2
(45) Date of Patent: Dec. 29, 2009

(54) INTERRUPTED FLOW RAPID CONFIRMATORY IMMUNOLOGICAL TESTING DEVICE AND METHOD

(75) Inventors: Naishu Wang, San Diego, CA (US); David F. Zhou, San Diego, CA (US)

(73) Assignee: DNT Scientific Research, LLC, San Diego, CA (US)

( * ) Notice: Subject to any disclaimer, the term of this patent is extended or adjusted under 35 U.S.C. 154(b) by 573 days.

(21) Appl. No.: 11/090,463

(22) Filed: Mar. 25, 2005

(65) Prior Publication Data

US 2005/0186111 A1 Aug. 25, 2005

Related U.S. Application Data

(63) Continuation-in-part of application No. 10/767,897, filed on Jan. 28, 2004, now abandoned.

(51) Int. Cl.

| | |
|---|---|
| ***G01N 21/05*** | (2006.01) |
| ***G01N 33/53*** | (2006.01) |
| ***B01L 3/00*** | (2006.01) |
| ***C12M 1/34*** | (2006.01) |

(52) U.S. Cl. ..... 422/58; 422/56; 422/68.1; 422/61; 422/102; 436/169; 436/514; 436/536; 435/287.1; 435/287.2; 435/287.3; 435/287.7; 435/286.5; 435/288.5; 435/7.1

(58) Field of Classification Search ..... 436/169, 436/174, 180, 514, 536; 422/56, 58, 68.1, 422/99, 100, 61, 102; 435/287.1, 287.2, 435/287.3, 287.6, 287.7, 7.1, 7.2, 286.5, 435/288.5

See application file for complete search history.

(56) References Cited

U.S. PATENT DOCUMENTS 4,299,916 A 11/1981 Litman et al.
4,313,734 A 2/1982 Leuvering (Continued)

OTHER PUBLICATIONS

POREX Lateral Flo Membrane flyer.

*Primary Examiner*—Maureen M Wallenhorst
(74) *Attorney, Agent, or Firm*—Charmasson, Buchaca & Leach, LLP

(57) ABSTRACT

A self-contained device using a gravitationally encouraged, interrupted downward and programmed flow of fluid to provide for rapid confirmatory immunological testing ("RCIT") in a point-of-care setting. A fluid specimen such as blood, saliva or urine is deposited into a first chamber carrying a colloidal conjugate of antigens or antibodies pathogenically specific to the condition being tested and premixed with a first measured, reactive mix buffer solution carried within an openable tank. Alternately, the buffer solution is preformulated to carry the colloidal conjugate in suspension. The premixture flows out of the first chamber toward chromatographic test strips having a single layer of uniformly dispersed porous matrix material such as polyethylene and inclined in a downward flow orientation. The flow is interrupted by a holding reservoir which is drained by siphoning, gravity and capillary forces. The delayed and regulated flow provides an incubation time for a better affinity binding of the specimen. In one embodiment, after a waiting period a bladder containing a stop-wash buffer solution is opened to flow into the reservoir and onto the strips. An absorbant pad collects excess fluid at the bottom end of the strips. It is a rapid confirmatory immunological test device having an analytical panel which can provide profile diagnostic results.

19 Claims, 4 Drawing Sheets

U.S. PATENT DOCUMENTS

| | | | | |
|---|---|---|---|---|
| 4,366,241 | A | 12/1982 | Tom et al. | |
| 4,703,017 | A | 10/1987 | Campbell et al. | |
| 4,775,636 | A | 10/1988 | Moeremans et al. | |
| 4,954,452 | A | 9/1990 | Yost et al. | |
| 5,252,459 | A | 10/1993 | Tarcha et al. | |
| 5,559,041 | A | 9/1996 | Kang et al. | |
| 5,591,645 | A | 1/1997 | Rosenstein | |
| 6,514,769 | B2 * | 2/2003 | Lee | 436/518 |
| 6,634,243 | B1 * | 10/2003 | Wickstead et al. | 73/863.23 |
| 6,663,833 | B1 * | 12/2003 | Stave et al. | 422/81 |

* cited by examiner

INTERRUPTED FLOW RAPID CONFIRMATORY IMMUNOLOGICAL TESTING DEVICE AND METHOD

PRIOR APPLICATION

This is a continuation-in-part of U.S. patent application Ser. No. 10/767,897 filed Jan. 28, 2004 now abandoned.

FIELD OF THE INVENTION

This invention relates to rapid confirmatory testing devices for analyzing body fluids and other fluids using immunochromatography, and more particularly to apparatuses for detection of antibodies or antigens in a point-of-care fluid test.

BACKGROUND

Over past decades, the prior art has offered several types of rapid diagnostic testing techniques primarily for body fluids. First, were the Latex Particle Agglutination tests, then the Flow Through tests leading to the current Lateral Flow Single Step test. However, in many settings these rapid tests are useful only for preliminary screening purposes, not as a confirmatory test. To this day, the Western Blot Analytical Assay is the only one reliably used for the confirmatory detection of HIV infection in a clinical laboratory setting worldwide. Due to its multi-step manipulation and verification phases, completion of this type of assay takes days, if not weeks. Such a delay can unfortunately lead to further propagation of infectious pathogens such as HIV or other serious results, such as the metastasis of cancers. There is virtually no practical or economical confirmatory rapid diagnostic testing technique for use in a point-of-care setting, available in the market place today.

Therefore, there is a need to refine the accuracy and expedite the performances of the common chromatographic rapid testing devices to a higher and new level for use in early confirmatory and speedy detection of the presence of pathogens or pathogenic conditions such as occurs with HIV infection, cancers and other disorders. Such a device could be easily adapted to detect certain lethal viruses, bacteria or other pathogenic antigens/antibodies in body fluids and other fluids used also in certain food and environmental testing, and to detect other abnormalities in body fluids which are indicative of various cancers, cardio-vascular diseases, and/or other disorders.

SUMMARY

The instant embodiments provide a device to more rapidly conduct a confirmatory immunoassay test for an analyte in question in a point-of-care setting.

In one embodiment there is provided a self-contained, multi-stage, programmed, interrupted downward flow, rapid confirmatory immunological testing ("RCIT") apparatus contained in a single molded enclosure. The immunoassay test can be performed in either a sandwich and/or competitive assay format. The apparatus can carry a number of chromatographic test strips in an inclined downward orientation forming down-flow strips. The primary exposure of a volume-measured fluid specimen to a specific antibody or antigen (or to a group thereof) conjugated to a label such as colloidal gold, or other type of label such as colloidal carbon, latex beads, or magnetic beads, etc. (hereinafter "conjugate") in a volume measured, reactive, buffered solution occurs in a first chamber before flowing on to contact down-flow strips in a second chamber. A holding reservoir located between the first and the second chambers can temporarily restrict the flow of the mixture to allow a short period of incubation before proceeding with the secondary specific immunological binding reaction in the down-flow strips. The down-flow strip is preferably not of the type used by prior lateral flow testing methods in that it is not directly connected with any colloidal gold conjugate pad, but rather only links with the bottom of the holding reservoir at the strip's top end. The down-flow strips preferably include only a single layer of uniformly dispersed porous matrix material such as uniformly porous polyethylene commercially available from Porex Corporation of Fairburn, Ga. coated with a number of corresponding antigenic epitopes (or polymers, proteins, polypeptides, etc.) which are immuno-determinants for an analyte in question such as a pathogen, such as the HIV or a condition such as cancer. In HIV confirmatory detection, the appearance of at least two epitope lines on a down-flow strip will not only confirm the presence of HIV, but will also give an analytical indication of the type of antibodies present in the specimen which can change during different periods of HIV infection and Acquired Immune Deficiency Syndrome (AIDS). Additionally, the down-flow strip or strips can include a control line, working as an internal system control indicator. Therefore, any positive result of HIV detection shown by this RCIT method can include at least three (3) lines appearing in the test reaction window.

In another embodiment, a supply of aqueous buffer solution is held in a sealed tank until the sample specimen has been introduced into the device and its cap closed. A prong in the undersurface of the cap punctures a membrane sealing the upper opening of the tank allowing the buffer solution to be dispensed into a first chamber under atmospheric pressure. A pad at the bottom of a second chamber in contact with a lower part of at least one down-flow strip absorbs the excess wash buffer that has not been retained by the strip. The strip or strips can be positioned in an incline rather than straight vertical position in order to reduce the height of the device. The flow out of the incubation reservoir and into the strip is prompted by a combination of siphoning, gravity and capillarity action forces.

In still another embodiment of the apparatus the enclosure has a slip-cover which is retracted to extend a spring-loaded support leg for orienting the device on an incline from horizontal. A first measured supply of aqueous mix buffer solution is held in a sealed tank until the sample specimen has been introduced through an inlet into the measured first chamber. The solution can contain the conjugate utilizing gold or other label in suspension, or alternately lyophilized conjugate can be carried on a specialized shelf or other structure within the first chamber. Under the push of a manipulable member, the tank seal is broken, causing the buffer to mix with the sample, and if present the lyophilized conjugate, for enough time to form a mixture which then flows out of the first chamber through continuous mixing into an incubation reservoir into which extends the ends of one or more down-flow oriented test strips.

The flow out of the incubation reservoir to the down-flow strips is prompted by a combination of siphoning, gravity and capillarity action forces. A hydrophilic absorptive pad such as a synthetic sponge is placed at the bottom of the second chamber in contact with a lower part of the strips to absorb the fluid and encourage the siphoning action. After waiting for an adequate amount of time for the mixture to flow down into and through the strips, a bladder containing an amount of wash buffer solution is opened under the push of another manipulable member to wash down the remaining mixture through the strips and end the reaction at the epitope lines on the strips. The lower pad absorbs the wash buffer and, along with the angled orientation of the strips, discourages reverse flow of fluid back up into the strips. Both of the manipulable members are slidable, built-in components of the apparatus.

Apart from its unique, self-contained measured volume mix and wash buffer tanks, and its simplified program for successively opening these tanks during processing, it is the interrupted down-flow action caused by siphoning, gravity, and to a lesser extent capillarity, from the incubation reservoir that improves accuracy and makes the apparatus well suited to rapid diagnostic point-of-care testing. The apparatus' ability to detect multiple antigenic markers or specific antibodies for single or multiple pathogens associated with one or more diseases or conditions provides a panel or profile based diagnosis with a high degree of sensitivity, specificity and accuracy which closely approaches or even surpasses the accuracy of Western Blot Analysis. Add to this its rapidity and long term storage stability at room temperature and it becomes an RCIT solution in the point-of-care setting.

In summary, the instant embodiments include, a flow immunoassay testing device for testing a fluid specimen, said device comprises a first chamber shaped and dimensioned to accept said specimen and be subjectable to a supply of buffer solution; a second chamber holding at least one chromatographic testing strip; and a flow-interrupting reservoir of a given capacity between said first and second chambers. The instant embodiments further include the strip or strips being held in a non-horizontal, downward flow orientation. Some embodiments further comprise means for causing a flow from the reservoir onto said strip, wherein the flow is the result of a combination of siphoning, gravitational and capillarity forces acting thereon. In still other embodiments the strip comprises a single layer of uniformly dispersed porous matrix material. In further embodiments the strip comprises a number of quantified test lines adapted to provide a measurable basis for a possible quantitative result display. The instant embodiments include the device further comprising a colloidal conjugate specific to a condition being tested. In some embodiments an amount of quantified conjugate can be lyophilized and carried upon a shelf or other structure within the first chamber. In other embodiments the buffer solution can be preformulated to carry an amount of said quantified conjugate in suspension. Other embodiments further comprise means for triggering the dispensing of the supply of buffer solution into the first chamber. Still other embodiments comprise a sampling well in communication with the first chamber and having a funnel-shaped internal wall. Other embodiments comprise an absorbing pad in contact with a bottom portion of said strip. Still other embodiments provide that the supply of buffer solution can be adjusted to create a minor overflow of said reservoir.

Other embodiments include a premix vessel containing said first chamber and a tank containing said supply of buffer solution, and an openable passageway between said tank and said first chamber. In some embodiments the premix vessel can further comprise a piston having a head and being slidingly engaged within a receptacle, wherein said head and said receptacle define said tank, thereby allowing a sliding translation between said piston and said receptacle to cause a pressurization of said tank; wherein said head is interposed between said tank and said first chamber. In still other embodiments the premix vessel can further comprise a membrane sealing said passageway; and, means for puncturing said membrane, thereby dispensing said amount of premix buffer solution through said passageway into said first chamber. The means for puncturing can comprise a spike extending from an inner wall of said receptacle, which is positioned to puncture said membrane upon translation between said receptacle and said piston beyond a first distance, thereby allowing sliding movement to pressurize said tank prior to said spike puncturing said membrane. In other embodiments the passageway can be dimensioned to cause a jet of said buffer solution into said first chamber.

In still other embodiments, the tank is further dimensioned to contain an amount of gas in addition to said measured amount of premix buffer solution, thereby allowing volumetric compression of said tank while said passageway is closed. The gas can be selected to have inert or inactive components such as nitrogen to help provide greater stability and a longer shelf-life at room temperature.

In still other embodiments, the apparatus further comprises an openable wash bladder shaped and dimensioned to releasably hold an amount of a wash buffer, wherein an outer surface of said bladder is in communication with said station. The wash bladder can be formed from frangible material. The apparatus can further comprise means for puncturing said bladder. In some embodiments, the means for puncturing can comprise a first spear slidingly mounted to said apparatus. The means for puncturing can further comprise a second spear positioned parallel to and spaced apart from said first spear. In some embodiments, the first spear has a length sufficient to puncture opposite walls of said bladder. In other embodiments, the first spear has an axial air channel.

In still other embodiments, the amount of premix buffer solution is preferably between about 200 microliters and about 300 microliters.

Other embodiments provide an interrupted downward flow fluid specimen testing apparatus comprising: a premix vessel containing a dispensable measured amount of premix buffer solution and having an inlet; and a test station shaped and dimensioned to hold at least one down-flow test device in a non-horizontal orientation; said premix vessel further having an outlet in communication with said test station. In some embodiments, the premix vessel comprises a first chamber in communication with said inlet; a tank shaped and dimensioned to hold said premix buffer solution; and an openable passageway between the tank and first chamber. The apparatus can further include a means for interrupting flow between the vessel and station.

Still other embodiments provide a method for premixing a measured buffer solution with a fluid specimen to form a mixture for dispensing to a down-flow test device, said method including the steps of: preloading said solution within a tank in a premix vessel; placing a fluid specimen in a premix chamber in said vessel; opening a passageway between said tank and said premix chamber, thereby creating a mixture of said solution and said specimen; and dispensing said mixture from said vessel to said device. In some embodiments, the method can further comprise pressurizing said tank prior to opening said passageway, such as by volumetrically compressing said tank. Alternatively, the pressurizing can comprise forming the tank from a hollow receptacle engaged by a piston carrying the chamber; and translating the receptacle with respect to the piston. In yet other embodiments the method can further comprise washing the down-flow test device after passage of a time period after dispensing the mixture from the vessel.

Yet other embodiments relate to an improved immunoassay testing device wherein a fluid specimen in a buffered solution is first contacted with a colloidal conjugate in a first part of said device, then applied to at least one testing strip in a second part of the device; the improvement comprising a flow interrupting reservoir between said first and said second parts. The improvement can further comprise orienting the strip in a non-horizontal orientation, especially for a downward movement of the two interrupted but consecutive (with only a minute apart from each other) flows. In some embodiments, the improvement further comprises an escape port in an upper part of the reservoir in communication the second part.

In still other embodiments, an immunoassay testing apparatus is provided which comprises: a first chamber; a means for exposing said first chamber to a colloidal conjugate in a movable carriage when said carriage is moved a first distance; a second chamber holding at least one down-flow testing strip; and a flow-interrupting reservoir of a given capacity between the first and second chambers. The apparatus can further comprise a supply of a mix buffer solution containing the conjugate. Alternatively or additionally, the apparatus can further comprise a sampling well in communication with said first chamber, wherein said sampling well comprises a funnel-shaped internal wall. In some embodiments, the means for exposing comprises: a tank holding said supply of buffer; a passageway between said tank and said first chamber; a membrane sealing said passageway; and means for puncturing said membrane, thereby dispensing said supply through said passageway. In some embodiments, the device further comprises a vessel carrying said tank and said carriage; and at least one spike extending from a wall of said vessel toward said membrane, said spike being shaped and dimensioned to puncture said membrane when said carriage is moved said first distance. Alternatively or additionally, the apparatus can further comprise an absorbing pad in contact with a portion of said strip. In some embodiments, the reservoir has an escape port in an upper part thereof whereby a liquid mixture from said first chamber must accumulate into said reservoir up to the level of said escape port before flowing freely into said second chamber. In some embodiments, the apparatus further comprises filtration material in said sampling well. In some embodiments, the supply of mix buffer solution is adjusted to create a minor overflow of said reservoir. In some embodiments, the second chamber holds a plurality of down-flow strips each having a plurality of test lines.

Yet other embodiments relate to an improved immunoassay testing device wherein a specimen is contacted with a movable and reactive solution, the resulting mixture is applied to at least one chromatographic test strip, and said strip is contacted by a movable wash solution, wherein the improvement comprises: a first built-in manipulable member for releasing said reactive solution onto said specimen; and a second, built-in manipulable member for releasing said wash solution onto said strip.

DESCRIPTION

Figure 1:
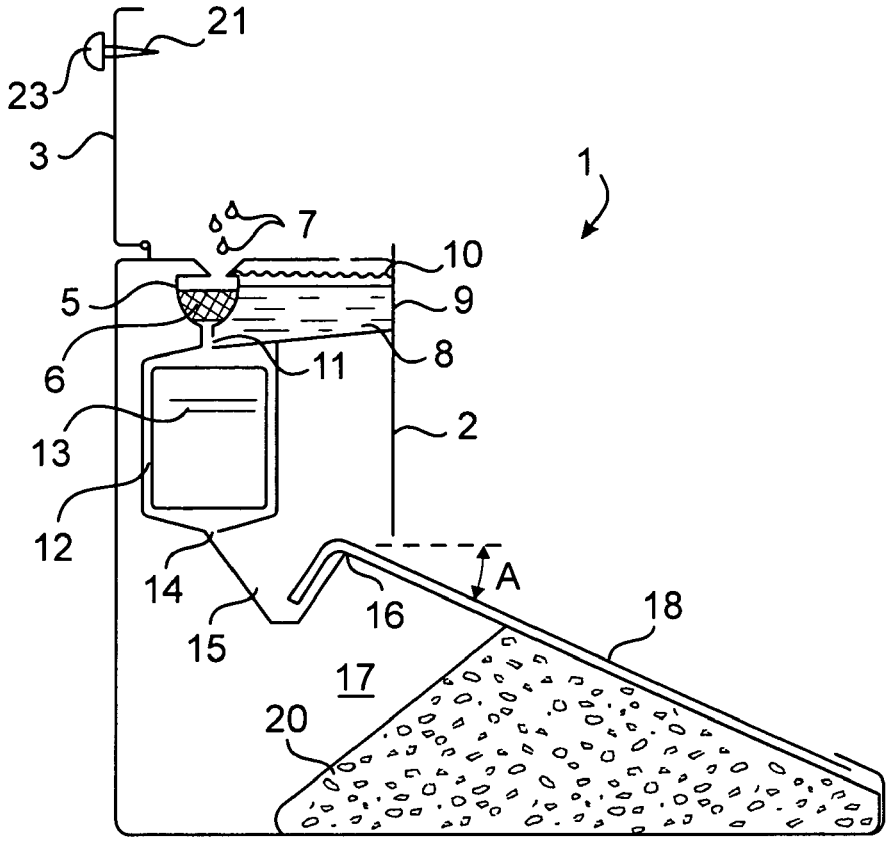
FIG. 1 is a diagrammatical cross-sectional illustration of a first embodiment of the interrupted flow testing device according to the invention.

The instant device is useful to determine the presence of analyte in a sample. The sample can include, for example, body fluids such as whole blood, serum, plasma, urine, spinal fluid, amniotic fluid, mucous, saliva, and the like.

Analyte, as used herein, refers to a compound or composition to be measured. The analyte can be any substance for which there exists a naturally occurring specific binding member such as a binding molecule (e.g., an antibody) or for which a specific binding member such as a binding molecule can be prepared.

Analyte also includes any antigenic substances, haptens, antibodies, and combinations thereof. The analyte can include a protein, a peptide, an amino acid, a ligand, a hormone, a steroid, a vitamin, a drug including those administered for therapeutic purposes as well as those administered for illicit purposes, a bacterium, a virus, and metabolites of or antibodies to any of the above substances. The analyte can also comprise an antigenic marker or antibody for single or multiple pathogenic conditions.

Representative analytes include steroids such as estrone, estradiol, cortisol, testosterone, progesterone, chenodeoxycholic acid, digoxin, cholic acid, digitoxin, deoxycholic acid, lithocholic acids and the ester and amide derivatives thereof; vitamins such as B-12, folic acid, thyroxine, triiodothyronine, histamine, serotonin, prostaglandins such as PGE, PGF, PGA; antiasthmatic drugs such as theophylline, antineoplastic drugs such as doxorubicin and methotrexate; antiarrhythmic drugs such as disopyramide, lidocaine, procainamide, propranolol, quinidine, N-acetylprocainamide; anticonvulsant drugs such as phenobarbital, phenytoin, primidone, valproic acid, carbamazepine and ethosuximide; antibiotics such as penicillins, cephalosporins, erythromycin, vancomycin, gentamicin, amikacin, chloramphenicol, streptomycin and tobramycin; antiarthritic drugs such as salicylate; antidepressant drugs including tricyclics such as nortriptyline, amitriptyline, imipramine and desipramine; as well as metabolites thereof. Additional therapeutic drugs include, for example, carbamazepine, free carbamazepine, cyclosporine, digoxin, FK778, gentamicin, lithium, N-acetylprocainamide, quinidine, tacrolimus, valproic acid, free valproic acid, vancomycin, and the like, as well as the metabolites thereof.

Representative analytes also include drugs of abuse, and their metabolites, including amphetamines, methamphetamines, barbiturates, benzodiazepines (BZD), cannabinoids, cocaine (benzoylecgonine), opiates, phencyclidine (PCP), tricyclic antidepressants (TCA), methadone, propoxyphene (PPX), marijuana (THC), methylenedioxymethamphetamine (MDMA, or Ecstasy, or XTC), morphine, oxycodone, and bupromorphine. Representative drugs of abuse include ethanol, heroin, hydromorphone, oxymorphone, metopon, codeine, hydrocodone, dihydrocodeine, dihydrohydroxy codeinone, pholcodine, dextromethorphan, phenazocine and deonin.

Hepatic analytes include, for example, albumin bromocresol green (BCG) or purple (BCP), alkaline phosphatase, hepatitis B core antigen/antibody (anti-HBc), hepatitis Be antigen/antibody (anti-HBe), hepatitis B surface antigen/antibody (anti-HBs), hepatitis C virus (HCV), anti-HCV, direct bilirubin, gamma-glutamyl transpeptidase (GGT), antibody to Hepatitis A virus (HAVAb)-IgG, HAVAb-IgM, hepatitis B surface antigen (HBsAg), lactate dehydrogenase (LD), neonatal bilirubin, prealbumin, total bilirubin, total protein, and the like.

Analytes related to pregnancy and fertility include, for example, human chorionic gonadotropin (hCG), beta-hCG, total beta-hCG, luteinizing hormone (LH), follicle stimulating hormone (FSH), dehydroepiandrosterone sulfate (DHEAS), estradiol, free estriol, total estriol, progesterone, prolactin, sex hormone binding globulin (SHBG), testosterone, and the like.

Analytes to determine blood disorders include, for example, B12, ferritin, folate, haptoglobin, and transferrin.

Analytes used to determine cardiac disorders include, for example, carcinoembryonic antigen (CEA), C-reactive protein (CRP), highly sensitive C-reactive protein (hsCRP), creatine kinase (CK), CK-MB, myoglobin, troponin, B-type natriuretic peptide (BNP), apolipoprotein A1, apolipoprotein B, and high density lipoprotein (HDL).

Cancer analytes include, for example, prostate specific antigen (PSA), free PSA, total PSA fecal occult blood (FOB), acid phosphatase, alphafetoprotein (AFP), beta2 microglobulin, CA 125™, CA 15-3™, CA 19-9™, carcino embryonic antigen (CEA), PAP, pepsinogen, squamous cell carcinomas (SCC), and the like.

Analytes associated with inflammation and immunology include, for example, C3, C4, CRP, IgA, IgG, IgM, RF, and the like.

Analytes used to determine exposure to disease causative organisms include, for instance, rubella IgG, rubella IgM, Toxoplasmosis IgG and IgM, cytomegalovirus (CMV) IgG and IgM, HTLV III, Anti-EBNA, mononucleosis, HAA, herpes, and anti-Streptolysin O.

Infectious disease analytes include microorganisms such as *Streptococcus pyogenes, Staphylococcus aureus* A, Chlamydia, Syphilis, Gonococcus, *Helicobacter pylori* (*H. pylori*). Additionally, disease analytes include viral organisms such as hepatitis (HBV, HBsAg, HCV, HAA), hepatitis A virus, hepatitis B virus, hepatitis non Non A-Non B, IgE, cytomegalovirus (CMV), herpes viruses, rubella viruses and the like. Further included, are, for example, toxoplasmosis, anti HTLV-I/HTLV-II, BSE, chagas antibody, CMV AB, CMV IgG, CMV IgM, CSF glucose, CSF protein, HIV AB HIV-1/HIV-2 (rDNA), rotazyme II, and the like.

Analytes pertaining to endocrinology include, for example, thyroglobulin autoantibodies (anti-Tg), thyroid peroxidase autoantibodies (anti-TPO), C-Peptide, Cortisol, HbAlc (hemoglobin fraction), PTH, Triiodothyronine (T3), free T3, total T3, thyroid hormone, Thyroxine (T4), free T4, total T4, thyroid stimulating hormone (TSH), and the like.

Pancreatic analytes include, for example, amylase, lipase, and the like.

Veterinary analytes include, for example, Heartworm Ag, *E. canis* Ab, Lyme Ab, Giardia, parvovirus, FIV, FeLV, and the like.

Analytes can also include, for example, insulin, gamma globins, allergens, cystic fibrosis, toxins, such as those associated with tetanus and animal venoms, and insecticides.

The precise nature of a number of analytes together with a number of examples thereof are disclosed in U.S. Pat. Nos. 4,299,916, Nov. 10, 1981, and 4,366,241, Dec. 28, 1982, each of which is hereby incorporated by reference in its entirety.

The signal provided to the user of the device is provided by a binding member such as a specific antibody and/or antigen ("binding molecule") conjugated to a label. Preferably labels that produce a readily detectable signal are used. Thus, colored labels permitting visible detection of the assay results without the addition of further substances and/or without the aid of instrumentation are preferred. Examples of labels that can readily detected include, for example, dye sols, metal sols, nonmetal sols, colored latex particles, color indicators, colored matter encapsulated in liposomes, and the like.

Metal sols are disclosed in U.S. Pat. Nos. 4,313,734, Feb. 2, 1982, 4,775,636, Oct. 4, 1988, each of which is hereby incorporated by reference in its entirety, and comprise a metal, a metal compound, such as metal oxides, metal hydroxides and metal salts, or polymer nuclei coated with a metal or metal compound. The metal sols can comprise, for example, metals such as platinum, gold, silver and copper. Alternatively, or additionally, the metal sols can comprise metal compounds, such as, for example, silver iodide, silver bromide, copper hydrous oxide, iron oxide, iron hydroxide or hydrous oxide, aluminum hydroxide or hydrous oxide, chromium hydroxide or hydrous oxide, vanadium oxide, arsenic sulphide, manganese hydroxide, lead sulphide, mercury sulphide, barium sulphate and titanium dioxide.

Nonmetal sols, such as carbon sols and their use are described in U.S. Pat. No. 5,559,041, Sep. 24, 1996, which is hereby incorporated by reference in its entirety. Nonmetal colloidal particles, such as selenium particles, are disclosed in U.S. Pat. No. 4,954,452, Sep. 4, 1990, which is hereby incorporated by reference in its entirety. Other nonmetals that can be used include elements within Group VI A. of the Periodic Table, sulfur, and tellurium.

Labels can also be formed from dye polymers, whereby dye molecules, or chromogenic monomers, are polymerized to form a colored polymer particle. Examples of such dyes include Congo red, Trypan blue, and Lissamine blue.

Organic polymer latex particles are disclosed in U.S. Pat. No. 5,252,459, Oct. 12, 1993, which is hereby incorporated by reference in its entirety. Such particles can comprise a plurality of non-chromophoric monomers.

Particulate labels comprising a dye or other colored substance enclosed in liposome sacs are described in U.S. Pat. Nos. 4,703,017, Oct. 27, 1987, and 5,591,645, Jan. 7, 1997, each of which is hereby incorporated by reference in its entirety.

The devices described herein use test strips that preferably comprise a dry porous material. By "porous" it is meant that the matrix is composed of a material into which fluids can flow and can easily pass through. Representative materials useful in practicing the invention described herein, include nylon, plastic, fiber containing paper, such as filter paper, chromatographic paper, and the like, nitrocellulose, glass fibers, polysulfone, polyvinylidene difluoride, polyurethane, and other porous polymers, polysaccharides, (e.g., cellulose materials, such as paper and cellulose acetate), silica, inorganic materials, such as deactivated alumina, diatomaceous earth, $MgSO_4$, or other inorganic finely divided material conveniently substantially uniformly dispersed in a porous polymer matrix, with polymers such as vinyl chloride, vinyl chloride-propylene copolymer, and vinyl chloride-vinyl acetate copolymer; cloth, both naturally occurring e.g., cotton and synthetic (e.g., nylon cloth), porous gels, (e.g., silica gel, agarose, dextran, and gelatin), polymeric films, (e.g., polyacrylamide), and the like. In preferred embodiments, the test strips comprise POREX CHEMISTRY A and/or POREX CHEMISTRY K membranes commercially available from Porex Corporation, Fairburn, Ga., and/or NOVYLON brand membrane commercially available from Cuno Incorporated, Meriden, Conn.

The preferred embodiments will be described in connection with the detection of HIV in a fluid specimen. Those skilled in the art will readily appreciate adaptation of these embodiments to detect other analytes indicative of other pathogens, or pathogenic conditions within body, food or environmental fluid samples.

Figure 2:
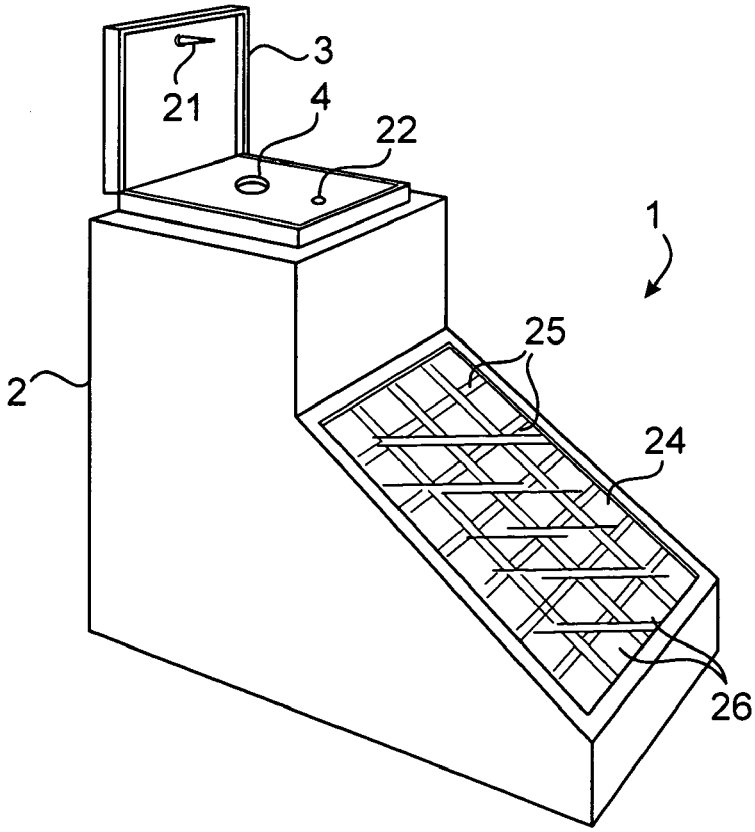
FIG. 2 is a perspective view of the device of FIG. 1.

Referring now to the drawing, there is shown in FIG. 1-2 a first embodiment of an immunoassay testing device 1 according to the invention. The device is preferably packaged in a molded plastic enclosure 2 topped by a sealing cap 3. In the upper region of the device, and immediately under a ceiling hole 4 is a sampling well 5. The internal wall of the well is funnel-shaped, and retains some filtration material 6. The geometry of that wall, whether in the form of a V or a U, has a portion of a relatively low pitch so that when a fluid specimen 7 such as whole blood, 7 or saliva runs along the wall, particles and adhesive matters are separated from the fluid component of the specimen. A supply of aqueous buffering solution 8 is held in a tank 9 along side the sampling well. The tank has a top opening hermetically sealed by a membrane 10, and a dispensing port 11 in a lower region leading to a first chamber 12 in a first analytical part of the device. The chamber is located immediately below the sampling well and receives the fluid component and is subjectable to the buffering solution. That first chamber holds colloidal gold conjugated specific to the HIV antigen or other colloidal conjugate 13 specific to the condition being tested that reacts with the fluid specimen in its buffered solution.

In some embodiments, the mix buffer comprises Borax: 2-3%; nonfat dry milk: 0.2-0.5%; Sucrose: 0.05-0.1%; NaN3: 0.4%; Rabbit IgG: 2%; Goat IgG: 2%; Human IgG: 0.2%; Tween 20: 0.5%.

An outlet 14 at the bottom of the chamber leads to an incubation reservoir 15 in which the solution flowing from the chamber accumulates and rests until the level of the solution reaches an upper part of the reservoir where an escape port 16 leads to a second chamber 17 holding one or more chromatographic testing strips held in a non-horizontal, downward flow orientation 18 and can be referred to as down-flow strips.

The membrane portion of the down-flow strips is in the preferred embodiments a single layer of substantially uniformly dispersed porous matrix material such as porous polyethylene commercially available from Porex Corporation of Fairburn, Ga. The substantially uniform dispersion of pores in the material reduces the negative effect of lot-to-lot variation present in prior strips. This greater predictability in how a given strip will perform enhances the ability of the device to provide a confirmatory test. Further, such predictability allows for the creation of a quantitative assay strip having a number of lines where each line is selected to appear at a different concentration threshold. In this way, the device carrying one or more quantitative assay strips can provide the digital display of a quantitative result.

Each down-flow strip 18 is preferably positioned in an inclined position at a pitch angle A of at least 15 degrees from the horizontal. The upper edge 19 of the strip dips into the reservoir and is contacted by the solution that flows down slowly under the effect of capillarity, gravity an siphoning forces enhanced by an absorbing pad 20 positioned in the bottom of the enclosure and in contact with the lower portion of the strip 18. In this way the second chamber 17 and strip form a siphon between the reservoir 15 and the absorbing pad.

The down-flow strips are coated with a number of binding members to the analyte. Examples include immuno-determinant epitopes of the HIV virus such as p18, p24, p32, gp36, gp41, p51, p55, p65, gp120, gp160 and subtype o.

Immobilization techniques include reel to reel dispenser of binding members such as binding molecules. The down flow test strips are then blocked to facilitate the test. Such a blocking procedure includes, for example, treating the strips with a buffer comprising Triton X-100: 1%; Polyvinyl Alcohol (PVA) (30,000-70,000 mw) or Polyvinyl Pyrrolidone (PVP) (10,000 mw): 1-1.5%; and Sugar: 0.2%.

It should be noted that the escape port 16 acts as a means for restricting the flow therethrough. Further, it should be understood that the dispensing of the buffer solution 8 out of the tank 9 is triggered by puncturing the membrane 10. The puncturing is accomplished by a prong 21 which extends from the underside of the cap 3 and passes through an aperture 22 in the roof of the enclosure. The prong is normally held into a retracted position during storage and shipment of the device, but can be moved to an extended position by manipulating a knob 23 on the outside of the cap. The prong is positioned, shaped and dimensioned to extend sufficiently through the aperture 22 into rupturing contact with the membrane 10.

The buffer solution 8 washes and carries the components of the specimen that comes down from the sampling well to form a mixture and provide the volume of fluid necessary 15 to fill the incubation reservoir and thus, regulate the transfer of the specimen through the device. By adjusting the volume of buffer solution to what is necessary to create a minor and/or relatively slow overflow of the reservoir, excessive flooding of the test strip is avoided.

It should be understood that the flow-interrupting reservoir 15 can assume a variety of positions and configurations that provides a temporary, but longer incubation time for the buffered sampling solution to complete the first affinity binding of the immuno-chemical reaction and reach a maximum, before it is contacted with the strip to form the second affinity binding of the immuno-chemical reaction, forming the double antigen (or double-antibody in some cases) sandwich-immuno complex. Within about 0.5-2 minutes, the relatively slow speed of the downward flow of the mixture caused by the combination of siphoning, gravity and capillarity action forces, promotes a maximum degree of the second affinity binding on the down-flow strips. The two maximized affinity binding steps in turn maximize the diagnostic sensitivity of the RCIT device technology.

A transparent window 24 sealed to the enclosure provides a direct viewing of chromatographic test lines 25 appearing on a number of down-flow test strips 26.

Figure 3:
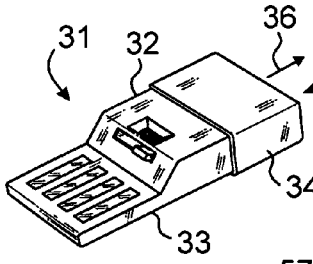
FIG. 3 is a perspective view of a second embodiment of the interrupted down-flow testing apparatus according to the invention in its retracted position.
Figure 4:
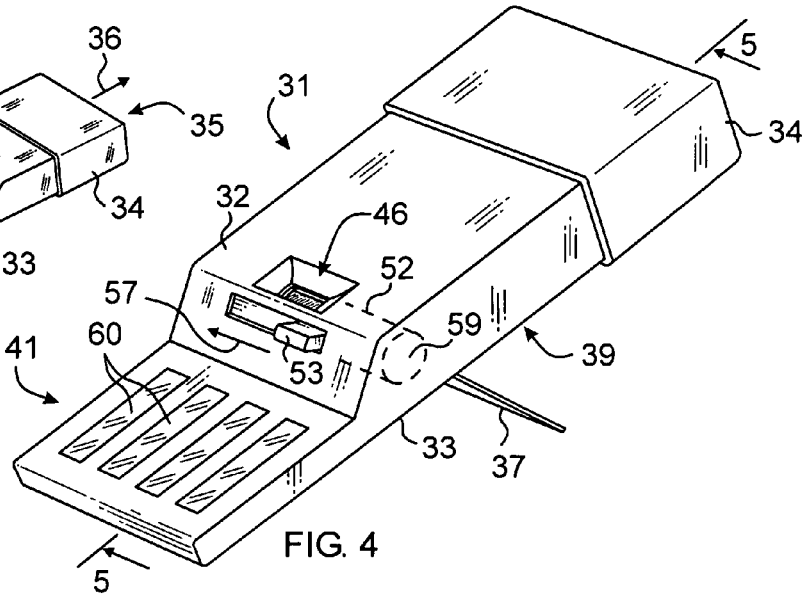
FIG. 4 is a perspective view of the interrupted down-flow testing apparatus of FIG. 3 in its extended position.
Figure 5:
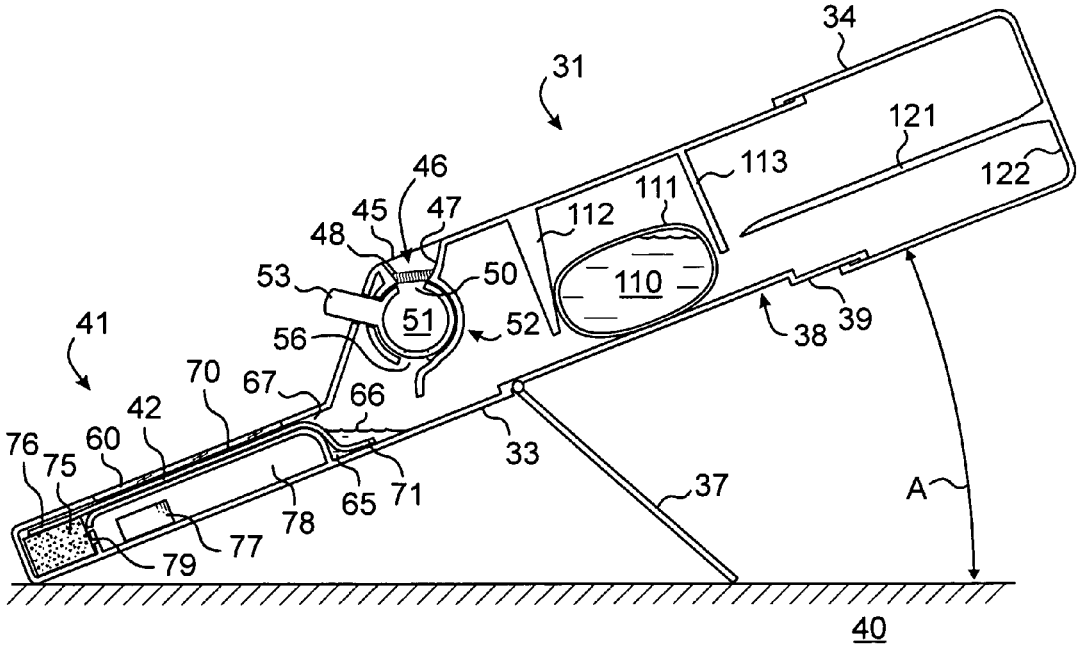
FIG. 5 is a diagrammatical cross-sectional side view of the device of FIG. 4 taken along line 5-5.

Referring now to FIGS. 3-5, there is shown a second embodiment of an immunoassay testing apparatus 31 according to the invention. The apparatus is preferably packaged in a molded plastic enclosure 32 having a base pan 33. An extendable and retractable slip-cover 34 is slidingly mounted at the back end 35 of the enclosure. The slip-cover is in a retracted position (as shown in FIG. 3) during storage and shipment of the device, but can be slid rearwardly to an extended position (as shown in FIG. 4) by pulling axially backward 36 on the slip-cover while holding the base pan 33 stationary. This action also causes the extension of a spring-loaded support leg 37 hingedly mounted within a recess 38 in the bottom outer surface 39 of the enclosure. The leg supports the apparatus upon a level surface 40 so that a test station 41 holding one or more down-flow testing strips 42 is oriented in an inclined position at a pitch angle A of at least 15 degrees from the horizontal.

In the medial region of the apparatus, and immediately under a ceiling hole 45 is a sampling well 46. The internal wall 47 of the well is funnel-shaped. The geometry of that wall, whether in the form of a V or a U, has a portion of a relatively low pitch so that when a fluid specimen such as whole blood or saliva runs along the wall, particles and adhesive matters are separated from the fluid component of the specimen. Alternately, or in addition to this feature, a screen 48 can be placed in the well to further help separate coarse particulates. The sampling well 46 leads downwardly through an inlet 50 to a first chamber 51 of a premix vessel 52 which receives the fluid component of the specimen in a first analytical part of the apparatus.

The test is initiated by the sliding manipulation 57 of a knob 53 which exposes and premixes the specimen with a measured amount of mix buffer solution 59 carried in an openable tank within the premix vessel. The solution holds in suspension an amount of colloidal gold conjugated specific to the HIV antigen for reaction with the specimen. In this way the solution can be characterized as a reactive solution. The first chamber is therefore subjectable to the mix buffer solution. In this way, the knob and vessel form a built-in manipulable member for releasing the mix buffer solution onto the specimen.

The amount of mix buffer solution is selected to adequately react with the amount of sample, and in this embodiment is preferably between about 200 and 300 microliters, and most preferably about 250 microliters. The mixture is dispensed through an outlet 56 at the bottom of the vessel and into a flow-interrupting incubation reservoir 65 before flowing on to one or more down-flow testing strips 42 held in the test station 41. A transparent window 60 sealed to the enclosure provides a direct viewing window of down-flow test lines appearing on the strips 42.

Situated between the premix vessel 52 and the test station 41 is the incubation reservoir 65 into which the mixture briefly accumulates and rests before being drawn into a second chamber 70 housing the down-flow strips. In the angled, test orientation, the reservoir has a given capacity. The location and capacity of the reservoir interrupts the flow, giving the mixture more time for the first affinity binding of the immuno-chemical reaction to occur and reach a maximum, before the mixture is contacted with the down-flow strips to form the second affinity binding of the immuno-chemical reaction. Within about 0.5-2 minutes, the relatively slow speed of the downward flow of the mixture caused by the combination of siphoning, gravity and capillarity action forces, promotes a maximum degree of the second affinity binding on the down-flow strips. The two maximized affinity binding steps in turn maximize the diagnostic sensitivity of the RCIT device technology.

The upper edge 71 of the strips dip into the reservoir 65 and are contacted by the pooled mixture 66. The mixture flows into the strips, under the combined effect of siphoning, gravity and capillarity forces, over the upper part of the reservoir through an escape port 67 and into the second chamber 70. Flow through the strips is enhanced by an absorbing pad 75 positioned in the bottom front end of the enclosure and in contact with the undersurface 76 of a lower portion of the strips 42. The size of the pad is selected to accommodate the combined volume of the fluids within the apparatus. A block of desiccant 77 is held in a third chamber 78 in the enclosure and is in communication with the second chamber 70 through holes 79 to help provide a room temperature storage shelf life for extended periods of time, such as for at least 24 months. Additionally, the entire apparatus is preferably kept in a sealed plastic foil pouch bag until use.

It should be understood that the flow-interrupting reservoir 65 can assume a variety of positions and configurations that provide a temporary, but longer incubation time for the mixture to complete the first affinity binding.

Figure 6:
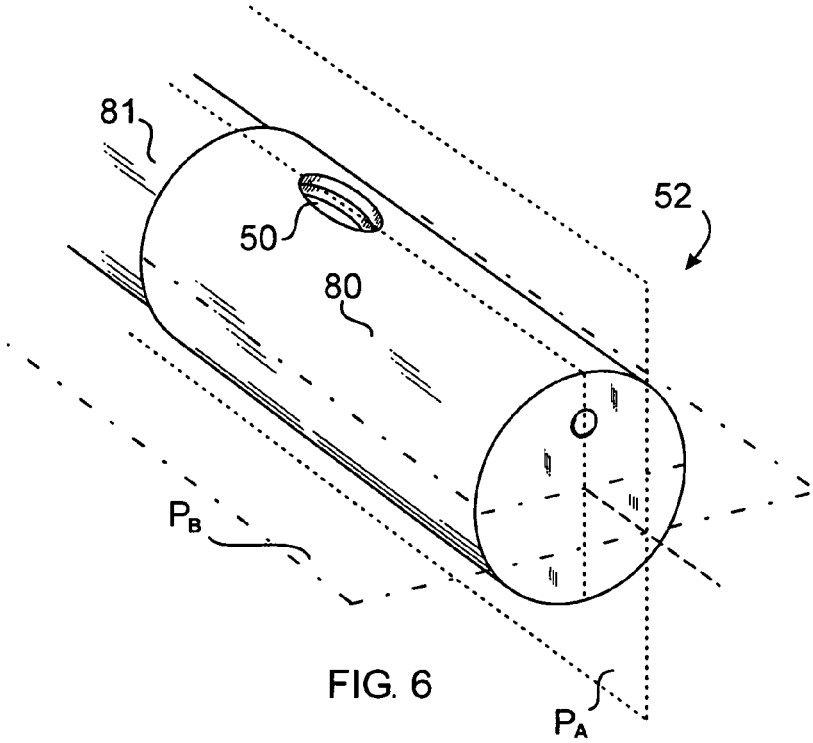
FIG. 6 is a diagrammatical partial perspective view of the premix vessel portion of the apparatus indicating the orientation of cross-section planes for FIGS. 7, 10 and 11.
Figure 7:
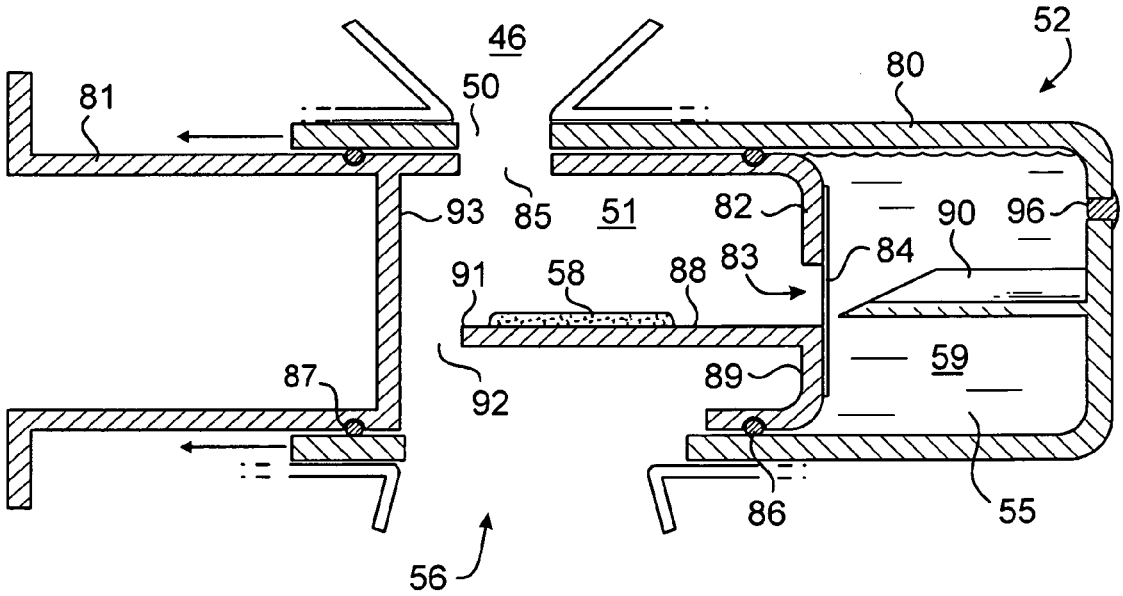
FIG. 7 is a diagrammatical cross-sectional side view of a first embodiment of the premix vessel according to the invention.

Referring now to FIGS. 5-7, the vessel 52 is formed to have a substantially cylindrical and axially translatable receptacle 80 engaged by substantially stationary piston 81. The head 82 of the piston and the receptacle define an enclosed and movable tank 55 which carries a measured supply of an aqueous mix buffer solution 59. The piston is hollow to define an internal cavity forming the first premix chamber 51. The head of the piston is interposed between and separates the tank from the premix chamber residing adjacent to it. A passageway 83 is formed through the piston head and is initially hermetically sealed by a frangible membrane 84 preferably made from a plastic laminated foil heat sealed to the outer surface of the piston head.

The fluid specimen can be, for example, body fluids such as whole blood, serum, plasma, urine, spinal fluid, amniotic fluid, mucous, saliva, and the like. Thus the test is initiated by placing the fluid specimen, which is typically a drop of blood for HIV testing, into the premix chamber 51 through an intake aperture 85 initially positioned below the vessel inlet 50 cut through the receptacle 80 and comes to rest upon a substantially horizontal shelf structure 88 extending from the inner wall 89 of the piston head toward a medial position in the premix chamber below the intake aperture 85 and terminating at an end 91 to form a drain 92 between the shelf end and the back wall 93 of the chamber. The shelf carries a pad 58 of porous inorganic material such as fibreglass (or 3M paper etc.) which has been impregnated with the proper colloidal gold conjugate in a lyophilized form to react with the specimen deposited thereon. By providing the conjugate in its dried form, the device can have a self life in excess of 2 years. The viscosity of the blood prevents it from flowing on its own through the drain. The location and dimensions of the shelf and drain can be adjusted or further selected to adapt the apparatus to other different viscosity fluid specimens.

The test is initiated by sliding manipulation of the knob 53 which is connected to the receptacle 80. The sliding translation of the receptacle over the piston 81, causes an axially channeled spike 90 extending from an inner wall of the tank to puncture the membrane 84 allowing the mix buffer solution 59 to be forcefully dispensed through the passageway 83 into the first chamber 51. Further translation volumetrically compresses the tank 55. The dimensions of the passageway, the spike and the spike's channel can be selected to cause a jet of buffer fluid to be directed against the specimen causing an agitated mixing of the buffer with the specimen to form a more thorough mixture. The lower viscosity mixture is then able to flow through the drain 92 and out of the vessel. Translation moves the position of the vessel inlet 50 to close the intake aperture 85 preventing backward flow of specimen out of the aperture. O-rings 86,87 discourage flow of fluid in the gap between the receptacle and piston.

It should be noted that the dispensing of the mixture out of the vessel 52 is triggered by puncturing the membrane 84. A plug 96 seals a tank fill port through the end wall of the receptacle.

Figure 8:
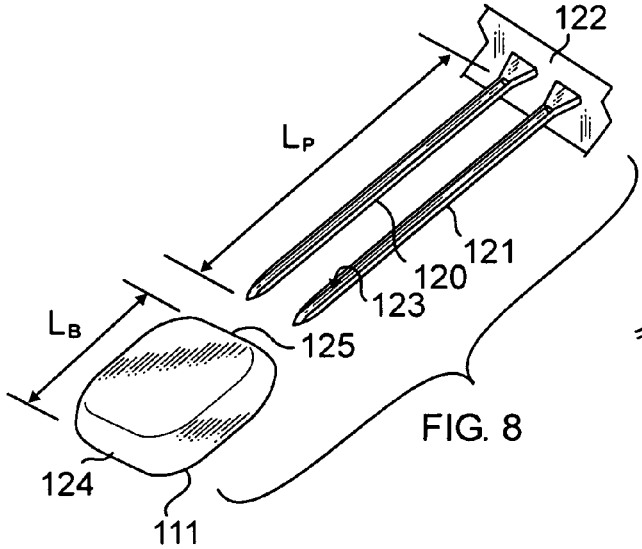
FIG. 8 is a diagrammatical partial perspective view of the wash bladder and puncturing prongs portion of the apparatus in an extended position.
Figure 9:
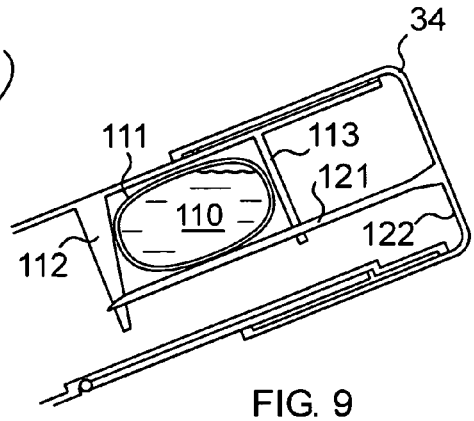
FIG. 9 is a diagrammatical cross-sectional side view of the rear portion of the enclosure showing the wash buffer bladder and puncturing prongs in their pretest position.

Referring to FIGS. 5, 8 and 9, the apparatus also optionally provides for a supply of a stop wash buffer solution to the down-flow strips in order to stop the reaction in the strips and to carry away lingering chemicals and residue which could serve to obscure the lines formed on the strips and also to remove any other non-specific materials from the reaction area. The wash buffer is preferably applied after a certain programmed waiting period which allows for the mixture to be drawn through the strips to an adequate degree. The preferred waiting time is of course dependent on the type of test being performed. For HIV detection the waiting period is preferably between about 0.5 and 2 minutes. The amount of wash buffer solution is selected to adequately wash the down-flow strips without unduly increasing the bulk of the apparatus, and in this embodiment is preferably between about 2 and 3 milliliters, and most preferably about 2.5 milliliters. In this embodiment the volume of wash buffer is about ten times that of the mix buffer.

For example, one such stop wash buffer comprises: Tween 20: 1%; Glycerol: 0.5%; Glycine: 5-20 mM; and NaN3: 0.02%.

The stop wash buffer solution 110 is contained in an frangible second tank or bladder 111 located upstream from the reservoir 65. In its pretest position (as shown in FIG. 9) the bladder rests atop a pair of prongs 120,121 extending forward from the rear wall 122 of the slip-cover 34 between a front stop 112 and a back stop 113 extending down from a ceiling of the enclosure. When the slip-cover 34 is moved to its extended position (as shown in FIGS. 5 and 8) the bladder falls to rest on the base pan 33. The bladder is opened by re-engaging the slip cover 34 which causes the prongs 120, 121 to puncture the bladder. It is understood that the bladder is in communication with the test station 41 meaning there is a fluid path from the bladder through the reservoir to the station. In this way, the slip-cover and prongs form a built-in, manipulable member for releasing the wash solution onto the down-flow strips.

As shown in FIG. 8, each prong is shaped to have an axial groove 123 which acts as an air channel to encourage the evacuation of the bladder when it is punctured. Further, the axial length $L_P$ of the prongs is selected to be greater than the length $L_B$ between the forward and rear axially opposite walls 124,125 of the bladder so that in the re-engaged position the prongs puncture both axially opposite walls causing the wash buffer to flow more rapidly out of the bladder which ensures rapid washing of the down-flow strips at the preselected appropriate time.

The second down-flow of the said stop wash buffer occurs relatively faster than the first down-flow of the mixture. The wash buffer having about ten times the volume of the mixture flushes out the non-specific binding caused by non-specific materials in the reaction area. This action maximizes the specificity of the present device to provide RCIT.

Figure 10:
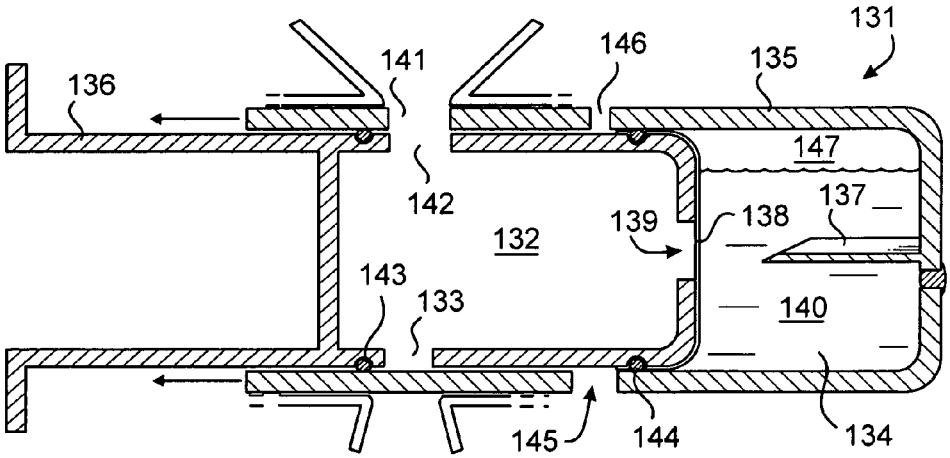
FIG. 10 is a diagrammatical cross-sectional side view of an alternate embodiment of the premix vessel according to the invention.

Referring now to FIG. 10, there is shown an alternate embodiment of the premix vessel 131 particularly adapted to samples having a relatively low viscosity such as urine. This embodiment is characterized by its premix chamber 132 having an initially sealed, openable drain 133. Further, the tank 134 formed between the receptacle 135 and the piston 136 is made to be volumetrically compressible prior to the spike 137 puncturing the membrane 138 sealing the passageway 139. In this way the mix buffer solution 140 is pressurized prior to puncturing to cause vigorous, thorough mixing. Further, the premix chamber is formed to have a limited volume which primarily acts to measure and mix the amount of the fluid specimen.

As the receptacle 135 is translated onto the piston 136, the receptacle acts as a movable carriage for the mix buffer tank and volumetrically compresses the tank 134. Further translation moves the position of the inlet 142 to close the intake aperture 141 preventing backward flow of specimen out of the inlet. O-rings 143,144 discourage flow of fluid in the gap between the receptacle and piston. Further translation causes the spike 137 to puncture the membrane 138 allowing the mix buffer solution to be forcefully dispensed through the passageway 139 into the first chamber 132 under pressure, collapsing the tank and thoroughly mixing the buffer with the specimen to form a mixture. Once fully collapsed, an outflow aperture 145 aligns with the vessel outlet 133 to allow evacuation the mixture therethrough. Full translation also causes the inlet 142 to be positioned below an air vent 146 which facilitates downward flow of the mixture out of the premix chamber by discouraging the formation of a vacuum.

It should be noted that the dispensing of the mixture out of the vessel 131 is triggered by puncturing the membrane 138. Further, in addition to the mix buffer supply, the tank holds an amount of a gas 147 to facilitate the volumetric compression of the tank during translation of the receptacle but before the membrane is punctured. The gas can be air, or is more preferably a gas which is inert or less reactive with the mix buffer and its suspended conjugates such as nitrogen in an effort to help the suspended conjugates to have a longer stability and shelf-life at room temperature.

Figure 11:
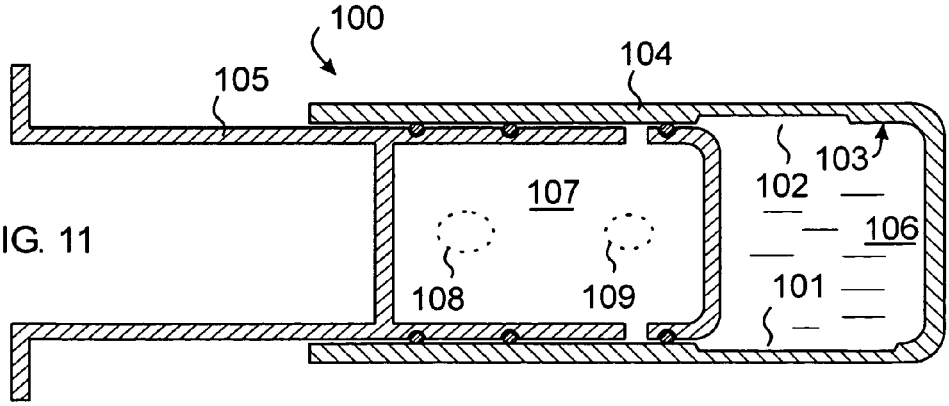
FIG. 11 is a diagrammatical cross-sectional top view of another alternate embodiment of the premix vessel according to the invention.

Referring now to FIG. 11, there is shown a second alternate embodiment of the premix vessel 100 in which the passageway is formed by axial depressions or channels 101,102 set into the inner surface 103 of the receptacle 104. In this way, translation of the piston 105 beyond a given distance will place the channels in communication with both the tank 106 and premix chamber 107 allowing the pressurized flow of the mix buffer into the first, premix chamber to mix with the specimen deposited through an inlet 108 and dispensed through a drain 109.

The interrupted down-flow test can rapidly provide an analytical panel or profile of antigen or antibody detection, and confirm the biochemical or pathogenic condition such as HIV infection, or early stage cancer prior to metastasis, or acute cardiac disorder by way of a simple, inexpensive and disposable device that can be manipulated safely by a relatively low skilled person. The above apparatus also benefits from dry chemistry storage, for an economically prolonged room temperature shelf life potentially in excess of 24 months.

It should be noted that the down-flow strip can be adapted especially for a downward movement of two interrupted but consecutive (with only about a minute apart from each other) flows utilizing a combination of siphoning, gravity, and to a lesser extent capillarity. Because the first affinity binding has already occurred in the first flow reaching the strip, the strip does not need to be directly connected with any colloidal conjugate pad, but only links with the incubation reservoir at its top end. Further, its membrane portion can be made from only a single layer of uniformly dispersed porous matrix material such as polyethylene.

The quality of the clinical performance of this novel platform technology surpasses any previous rapid testing technologies, such as Latex particle agglutination, Flow-Through test, and the currently wide-spread Lateral Flow devices. It is a technology of Rapid Confirmatory Immunological Testing (RCIT).

While the preferred embodiment of the invention has been described, modifications can be made and other embodiments may be devised without departing from the spirit of the invention and the scope of the appended claims.

What is claimed is:

1. A flow immunoassay testing device for testing a specimen, said device comprises:

a supply of buffer solution;

an amount of conjugate specific to a condition being tested;

a first chamber shaped and dimensioned to accept said specimen and be subjectable to said supply of buffer solution to create a fluid comprising said specimen and said solution;

said first chamber holding said amount of conjugate;

a siphon enhancing absorbing pad;

a second chamber in fluid communication with said first chamber, said second chamber siphoningly holding at least one chromatographic testing strip;

a reservoir having a given capacity and being located to interrupt a flow of said fluid between said first and second chambers;

said reservoir having an escape port in an upper part thereof; and said at least one strip having an upper edge dipping into said reservoir through said escape port and a downward pitch between said port and a lower portion in contact with said pad to form a siphon between said reservoir and said pad;

whereby an amount of said fluid is accumulated in said reservoir and incubated to allow a first affinity binding reaction to occur within said amount of said fluid to form an incubated liquid which flows slowly out of said reservoir through said escape port and into said at least one strip under the effect of capillarity, gravity and siphoning forces.

2. The device of claim 1, wherein said at least one strip comprises a single layer of uniformly dispersed porous matrix material.

3. The device of claim 2, wherein said at least one strip comprises a number of test lines adapted to provide a measurable basis for quantitative result display.

4. The device of claim 1, wherein an amount of said conjugate is lyophilized and carried on a structure within said first chamber contactable by said fluid.

5. The device of claim 1, wherein said supply of buffer solution is preformulated to carry an amount of said conjugate in suspension.

6. The device of claim 1, which further comprises means for triggering the dispensing of said supply of buffer solution into said first chamber.

7. The device of claim 1, wherein said supply of buffer solution is adjusted to create a minor overflow of said reservoir.

8. The device of claim 1, which further comprises:

a premix vessel containing said first chamber and a tank containing said supply of buffer solution, and an openable passageway between said tank and said first chamber.

9. The device of claim 8, wherein said premix vessel further comprises:

said tank comprising:

a piston having a head; and said piston being slidingly engaged within a receptacle, thereby allowing a sliding translation between said piston and said receptacle to cause a pressurization of said tank.

10. The device of claim 9, wherein said premix vessel further comprises:

a membrane sealing said passageway; and, means for puncturing said membrane, thereby dispensing said amount of premix buffer solution through said passageway into said first chamber.

11. The device of claim 10, wherein said means for puncturing comprise a spike extending from an inner wall of said receptacle, said spike being positioned to puncture said membrane upon translation between said receptacle and said piston beyond a first distance, thereby allowing sliding movement to pressurize said tank prior to said spike puncturing said membrane.

12. The device of claim 8, wherein said passageway is dimensioned to cause a jet of said supply of buffer solution into said first chamber.

13. The device of claim 8, wherein said rank is further dimensioned to contain an amount of gas, thereby allowing volumetric compression of said tank while said passageway is closed.

14. The device of claim 1, which further comprises an openable wash bladder shaped and dimensioned to releasably hold an amount of a wash buffer, wherein an outer surface of said bladder is in communication with said second chamber.

15. The device of claim 14, wherein said wash bladder is formed from frangible material.

16. The device of claim 15, which further comprises first and second spears slidingly mounted to said device; said spears being oriented and having a length sufficient to puncture opposite walls of said bladder when said spears are slid into said bladder, thereby opening said bladder and releasing said amount of wash buffer.

17. The device of claim 16, wherein said first spear has an axial air channel.

18. The device of claim 1, wherein said supply of buffer solution has a volume between about 200 microliters and about 300 microliters.

19. An immunoassay testing device comprises:

a specimen;

a buffer solution;

a conjugate specific to a condition being tested;

a first part of said device for accepting said specimen, said buffer solution, and said conjugate to create a fluid flow;

said first part comprising:

a reservoir interrupting said fluid flow for a time sufficient to incubate a first affinity binding reaction between said conjugate and said specimen and thereby create an incubated liquid;

a second part of said device in fluid communication with said first part, wherein said reservoir is located between said first part and said second part, said second part comprising:

a chamber shaped and dimensioned to siphoningly hold at least one chromatographic testing strip in a downward orientation, wherein an upper portion of said at least one strip dips into the reservoir and a lower portion of said at least one strip is in contact with a siphon enhancing absorbing pad, whereby an amount of said incubated liquid flows into said at least one strip under the combined effect of capillarity, gravity and siphoning forces.

* * * * *